United States Patent [19]

Ng et al.

[11] Patent Number: 4,532,032

[45] Date of Patent: Jul. 30, 1985

[54] POLYORGANOSILOXANE COLLECTORS IN THE BENEFICIATION OF FINE COAL BY FROTH FLOTATION

[75] Inventors: Fook L. Ng, Dee Why; Bruce S. Higgs, St. Marys, both of Australia

[73] Assignee: Dow Corning Corporation, Midland, Mich.

[21] Appl. No.: 615,433

[22] Filed: May 30, 1984

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS 3,072,256 1/1963 Gotte et al. ..... 209/167

FOREIGN PATENT DOCUMENTS 582839 12/1977 U.S.S.R. ..... 209/166
650656 3/1979 U.S.S.R. ..... 209/166
652974 3/1979 U.S.S.R. ..... 209/166
657855 4/1979 U.S.S.R. ..... 209/166

*Primary Examiner*—Bernard Nozick
*Attorney, Agent, or Firm*—Richard A. Kaba

[57] ABSTRACT

A froth flotation process for the beneficiation of fine coal is disclosed which employs as a collector a water-dispersible polyorganosiloxane or a mixture of water-dispersible polyorganosiloxanes which contain either aryl radicals or aryl radicals combined with polyethylene oxide and polypropylene oxide radicals. Preferred polyorganosiloxanes are those which contain both aryl radicals and polyethylene oxide and/or polypropylene oxide radicals. The process of this invention is espeically useful for the beneficiation of difficult-to-float fine coals.

34 Claims, No Drawings

POLYORGANOSILOXANE COLLECTORS IN THE BENEFICIATION OF FINE COAL BY FROTH FLOTATION

BACKGROUND OF INVENTION

This invention relates to a froth flotation process for the beneficiation of fine coal. More specifically, this invention relates to a froth flotation process for the beneficiation of fine coal using certain polyorganosiloxanes as collectors. The polyorganosiloxane collectors of this invention allow for improved beneficiation of fine coals, especially the difficult-to-float coals including highly oxidized coals.

In general, a froth flotation process for the beneficiation of fine coal occurs as finely disseminated air bubbles are passed through an aqueous fine coal slurry. Air bubble adhering particles (coal) are separated from the nonadhering particles (tailings) by flotation of the coal particles to the surface of the aqueous slurry where they are removed as a concentrate. The tailings or waste remain suspended in the slurry or fall to the lower levels of the slurry. Suitable reagents are normally added to the aqueous fine coal slurry to improve the selectivity and/or recovery of the process. Collectors and frothing agents are two types of additives which are normally used. The basic purposes of a frothing agent is to facilitate the production of a stable froth. The froth should be capable of carrying the beneficiated fine coal until it can be removed as a concentrate. The basic purpose of a collector is to render the desired coal particles hydrophobic so that contact and adhesion between the desired coal particles and the rising air bubbles is promoted. At the same time, the collector should be selective in that the tailings or waste are not rendered hydrophobic and thus do not float. Collectors are generally surface active reagents which preferentially wet or adsorb on coal surfaces and thus enhance the hydrophobic character of the coal particle by giving the coal surface a water repellent coating. Water insoluble, neutral hydrocarbon liquids derived from petroleum, wood, or coal tars have been employed in the froth flotation of coal. Diesel fuel, fuel oil, and kerosene are the most widely used collectors. In specific instances, other flotation reagents may be used. Such additional flotation reagents include depressing agents, activating agents, pH regulators, dispersing agents, and protective colloids which are well known in the art.

Polyorganosiloxanes have been used in mineral flotation processes. Schoeld et al. in U.S. Pat. No. 2,934,208 (issued Apr. 26, 1960) concentrated a coarse sylvite fraction from a sylvite ore using froth flotation with a collector containing both an aliphatic amine and a water insoluble silicone fluid. The silicone fluid employed by Schoeld et al. included dimethyl silicones, phenyl silicones, and methyl hydrogen silicones. Gotte et al. in U.S. Pat. No. 3,072,256 (issued Jan. 8, 1963) discloses the separation of galena and sphalerite present in sulphidic ores by froth flotation using conventional frothing agents and polyorganosiloxanes as collectors where the polyorganosiloxane is in the form of an emulsion with a surface-active nitrogen-containing organic compound. The polyorganosiloxanes of Gotte et al. contained methyl radicals and at least one alkyl radical containing more than two carbon atoms. Smith et al. in U.S. Pat. No. 3,640,385 (issued Feb. 8, 1972) teaches the concentration of sylvite from sylvinite or other potassium chloride ores using a froth flotation system with small amounts of silicone polymers as auxiliary agents in conjunction with primary amines and aliphatic and/or aromatic oils as collectors. The organic radicals on the silicone polymers of Smith et al. included methyl, phenyl, ethyl, propyl, butyl, hydrogen, chlorine, and bromine radicals. Leonov et al., in USSR Inventor Certificate No. 652,974 (Mar. 25, 1979), employed di-[2--(glycidyloxy)ethoxyethyl]ether-1,3-di(oxymethyl)tetra-methyldisiloxane as a frothing agent in the froth flotation of a lead-zinc ore.

Siloxanes have also been used to a limited extent in the froth flotation of coal. Petukhov et al., in USSR Inventor Certificate No. 582,839 (Dec. 5, 1977), employed a mixture of linear and cyclic polysiloxanes of the general formula $$Si_nO_{n-1}(OC_2H_5)_{(2n+2)}$$

where n is 2–4 and

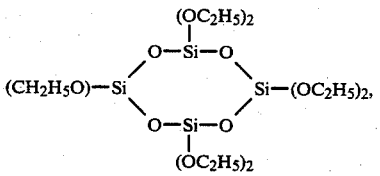

respectively, as frothing agents for the froth flotation of coal. The collector employed was kerosene. Petukhov et al., in USSR Inventor Certificate No. 650,656 (Mar. 5, 1979) employed polyhaloorganosiloxanes containing methyl, ethyl, $—C_6H_5X_2$, and $—CH_2CH_2CX_3$ radicals, where X is a halogen atom, as frothing agents in the flotation of coal. The collector employed was kerosene. Polydimethylsiloxanes have also been used in the froth flotation of coal with only limited success.

An object of this invention is to provide an improved froth flotation process for the beneficiation of fine coal. Another object is to provide new polyorganosiloxane collectors for use in the froth flotation of fine coal. Other objects will be apparent to one skilled in the art upon consideration of this specification.

THE INVENTION

This invention relates to a froth flotation process for the beneficiation of fine coal, which process comprises the steps of forming an aqueous slurry of the fine coal, adding a collector and a frothing agent to the aqueous fine coal slurry, subjecting the aqueous fine coal slurry containing the collector and frothing agent to a froth flotation manipulation, and separating the tailings of the froth flotation manipulation from the floated material which consists essentially of the beneficiated fine coal, wherein the collector is a water-dispersible polyorganosiloxane, or mixture of water-dispersible polyorganosiloxanes, which contain aryl radicals attached to silicon through a Si—C bond.

This invention also relates to a froth flotation process for the beneficiation of fine coal, which process comprises forming an aqueous slurry of the fine coal containing a collector and a frothing agent, subjecting the aqueous slurry of the fine coal containing the collector and frothing agent to a froth flotation manipulation, and separating the tailing of the froth flotation manipulation from the floated material which consists essentially of the beneficiated fine coal wherein the collector is a water-dispersible polyorganosiloxane or a mixture of water-dispersible polyorganosiloxanes of general formula $$Q_cR_{(3-c)}SiO[R_2'SiO]_n[R'QSiO]_mSiR_{(3-d)}Q_d$$

where n has a value of 0 to 100, inclusive; m has a value of 0 to 70, inclusive; c and d are both independently equal to 0 or 1; the sum (m+c+d) is equal to or greater than 1; R is a monovalent alkyl radical containing from 1 to 20, inclusive, carbon atoms or a —OH radical; R' is a monovalent alkyl radical containing from 1 to 20, inclusive, carbon atoms; and at least two different Q radicals are present where the first Q radical is an aryl radical and the second Q radical is selected from the group consisting of polyethylene oxide radicals and polypropylene oxide radicals where said Q radicals are attached to silicon through a Si—C bond.

This invention relates to a froth flotation process for the beneficiation or purification of fine coal. Coals which may be treated by the process of this invention include mainly the bituminous coals although other coals may be treated. Although the process of this invention may be used for coals which are easy-to-float using conventional collectors, this process is especially useful for the difficult-to-float coals. An example of such a difficult-to-float coal would be a coal which is highly oxidized. Such highly oxidized coals can be floated with conventional collectors only with difficulty resulting in an uneconomical process with poor recovery and/or poor selectivity.

Generally the fine coal to be purified by the process of this invention has particles less than about 30 mesh (0.6 mm). Although larger particle size coal fractions may be purified by the froth flotation process of this invention, such a process will generally be uneconomical. It is generally preferred that the fine coal purified by the process of this invention have a particle size of less than about 50 mesh (0.3 mm). Naturally, coals with much smaller particle sizes may be purified by the froth flotation process of this invention. In fact, for coals less than 200 mesh (0.075 mm), a froth flotation process may be the only commercially available method for the coal beneficiation.

To treat a fine coal material by the process of this invention, the fine coal must be in the form of an aqueous slurry. The solids content or pulp density of the aqueous slurry will depend on the specific coal that is to be processed. Generally, the aqueous slurry will contain from about 2 to 25 percent coal solids. Normally, a higher pulp density is employed with coarser coal particles and a lower pulp density is beneficial with finer coal particles. For very small coal particles (less than 200 mesh), pulp densities of about 2 to 5 percent are normally preferred. As one skilled in the art realizes, these pulp density ranges are intended only as guidelines. The optimum pulp density for a given fine coal and processing conditions should be determined by routine experimentation.

In the operation of the process of this invention, a frothing agent and a collector are added to the aqueous slurry of the fine coal. The collector and frother, but especially the collector, may be added to the aqueous medium before the fine coal is slurried if desired. The frothing agent and collector may be added at the same time or at separate times. For a difficult-to-float coal it is generally preferred that the collector be added to the aqueous slurry well before the actual froth flotation manipulation. By adding the collector for the aqueous slurry well upstream of the froth flotation cell, sufficient time for conditioning the coal particles is allowed. For the less difficult-to-float coal the collector may be added just before the actual froth flotation cell or upstream of the actual froth flotation cell. It is generally preferred that the frother be added just prior to the actual froth flotation manipulation in order to obtain a good froth for the actual froth flotation manipulation.

The collector and frother are added at a concentration level sufficient to obtain the desired beneficiation result. In practice, the actual collector and frother concentration level will be determined by the actual collector and frother used, the coal employed, the particle size distribution of the coal particles, the pulp density, the desired beneficiation effect, as well as other factors. Although the quantity of added reagents used will vary widely with conditions, frothers are usually added at a rate of about 0.05 to 2.0 kg per ton of coal and collectors at a rate of about 0.05 to 1.0 kg per ton of coal. Again these rates are intended only as guidelines. Higher or lower amounts may be useful in specific circumstances.

Frothers are used in the froth flotation process of this invention to facilitate the production of a stable froth. The frothers or frothing agents useful in this invention are well known in the art. Conventional frothing agents include, for example, aliphatic alcohols which are only slightly soluble in water such as amyl alcohols, butyl alcohols, terpinols, cresols, and pine oils. A preferred frothing agent is methylisobutylcarbinol.

The collectors used in this present invention are water-dispersible polyorganosiloxanes, or mixtures of water-dispersible polyorganosiloxanes, which contain one or more different types of organic radicals where the organic radicals are attached to silicon through a Si—C bond and are selected from the group consisting of aryl radicals and the combination of aryl radicals with polyethylene oxide and polypropylene oxide radicals. In addition to the aryl, polyethylene oxide, and polypropylene oxide radicals, the polyorganosiloxanes may, and preferably do, contain monovalent alkyl radicals which contain from 1 to 20, inclusive, carbon atoms when the monovalent alkyl radicals are attached to silicon through a Si—C bond. Preferably, the monovalent alkyl radicals are methyl radicals. Hydroxyl radicals attached directly to silicon may also be present in the polyorganosiloxanes of this invention.

Representative examples of suitable aryl radicals include phenyl ($C_6H_5$—), benzhydryl ($(C_6H_5)_2CH$—), benzyl ($C_6H_5CH_2$—), alpha-methylbenzyl ($C_6H_5CH(CH_3)$—), methylbenzyl ($CH_3C_6H_4CH_2$—), tolyl ($CH_3C_6H_4$—), phenethyl ($C_6H_5CH_2CH_2$—), alpha-methylphenethyl ($C_6H_5CH(CH_2CH(CH_3)$—), beta-methylphenethyl ($C_6H_5CH(CH_3)CH_2$—), and the like. Preferred aryl radicals are phenyl and beta-methylphenethyl radicals.

The polyethylene oxide and polypropylene oxide radicals may be represented by the general formula $$-D(OC_2H_4)_x(OC_3H_6)_yB.$$

In this structure D can be any alkylene radical containing from 2 to 18 carbon atoms. Thus D can be, for example, an ethylene, propylene, isopropylene, butylene, isobutylene, hexylene, octylene, decylene, dodecylene, hexadecylene or an octadecylene radical. It is preferred that D be an alkylene radical containing from 2 to 6 carbon atoms. The number of polyethylene oxide units present is defined by x which may vary from 0 to 20, inclusive. It is preferred that x range from 5 to 15, inclusive. The number of polypropylene oxide units present is defined by y which may vary from 0 to 5, inclusive. The sum (x+y) must be greater than or equal to 1. When x equals zero, the above formula describes a polypropylene oxide radical; when y equals zero the above formula describes a polyethylene oxide radical. Radicals containing both polyethylene oxide and polypropylene oxide units are suitable for use in the invention. It is preferred, however, that the radical contains only ethylene oxide units (y equals 0). When both ethylene oxide and propylene oxide units are present, the ratio of x to y is preferably at least 2 to 1. The final portion of the glycol is B which is a capping group selected from the group consisting of the $$-OR'',\ -O\overset{O}{\overset{\|}{C}}R'',\ -O\overset{O}{\overset{\|}{C}}OR'',\ \text{and}\ -O\overset{O}{\overset{\|}{C}}D'COOH\ \text{radicals}$$

wherein R'' is a hydrogen atom or a hydrocarbon radical free of aliphatic unsaturation which contains from 1 to 10 carbon atoms and D' is an alkylene radical containing from 1 to 18 carbon atoms. By way of illustration, the polyethylene oxide and/or polypropylene oxide radicals can be hydroxy, ether, carboxyl, acyloxy, carbonate or ester capped. Specific examples of R'', in addition to the hydrogen atom, include the methyl, ethyl, propyl, butyl, isopropyl, cyclohexyl, phenyl, tolyl, benzyl, and decyl radicals. Specific examples of D' include methylene, ethylene, propylene, isopropylene, butylene, isobutylene, hexylene, octylene, decylene, dodecylene, hexadecylene, octadecylene, 1-dodecylethylene, 2-dodecylethylene and other aliphatic substituted alkylene radicals.

Polyorganosiloxanes or mixtures of polyorganosiloxanes which contain aryl radicals are useful as collectors in this invention. It is generally preferred, however, that the polyorganosiloxane, or mixture of polyorganosiloxanes, contain aryl radicals and radicals selected from the group consisting of polyethylene oxide and polypropylene oxide radicals. This combination of the different radicals may be present on the same polyorganosiloxane species or may be obtained by physically blending two or more polyorganosiloxanes each of which only have one type of radical.

Polyorganosiloxanes which are useful in the process of this invention have the general formula $$R_aQ_bSiO_{(4-a-b)/2}$$

where a and b are numbers, the sum of which has an average value of 0.9 to 2.7, a has an average value of 0 to less than four, b has an average value of greater than zero to less than four, R is a monovalent alkyl radical containing from 1 to 20, inclusive, carbon atoms or a —OH radical, and Q is an organic radical attached to silicon through a Si—C bond and selected from the group consisting of aryl radicals and aryl radicals with polyethylene oxide and polypropylene oxide radicals as described above. The polyorganosiloxane may contain siloxane units of the general formula $R_3SiO_{1/2}$, $R_2SiO$, $RSiO_{3/2}$, $SiO_2$, $R_2QSiO_{1/2}$, $RQ_2SiO_{1/2}$, $Q_3SiO_{1/2}$, $RQSiO$, $Q_2SiO$, $QSiO_{3/2}$. It is generally preferred, however, that siloxane units which contain more than one Q radical are present in limited amounts or not at all. It is also preferred that the amounts of monoorganosiloxane units and, especially, $SiO_2$ units be limited to less than 10 mole percent and, most preferably, less than 1 mole percent.

Preferred polyorganosiloxanes may be represented by the general formula $$Q_cR_{(3-c)}SiO[R_2'SiO]_n[R'QSiO]_mSiR_{(3-d)}Q_d,$$

where n has a value of 0 to 25, inclusive, preferably 0 to 5, inclusive; where m has a value of 0 to 12, inclusive, preferably 1 to 5, inclusive; c and d are both independently equal to 0 or 1; and the sum (m+c+d) is greater than or equal to one. It is preferred that both c and d are zero in which case m has a value of 1 to 12, inclusive, and the polyorganosiloxane formula reduces to $$R_3SiO[R_2'SiO]_n[R'QSiO]_mSiR_3,$$

where R, R', and Q are as defined above. As noted before, it is preferable that at least two different Q radicals be present, one being an aryl radical and the other being selected from the group consisting of polyethylene oxide and polypropylene oxide radicals. The different Q radicals may be on the same polyorganosiloxane molecule or may be on different polyorganosiloxanes in a mixture of polyorganosiloxanes.

The polyorganosiloxanes that are useful in the process of this invention may be prepared by any of the methods disclosed in the art. Most useful polyorganosiloxanes have been disclosed in the voluminous polyorganosiloxane art; many are commercially available.

The polyorganosiloxanes or mixtures of polyorganosiloxanes must be water-dispersible; that is to say, the polyorganosiloxanes or mixtures of polyorganosiloxanes must be soluble in water or emulsifiable in water. The water-emulsifiable polyorganosiloxane may be self-emulsifiable or it may be emulsifiable with the aid of one or more surfactants or it may be prepared in emulsified form by emulsion polymerization of suitable monomers. In the process of this invention the polyorganosiloxane collector may be added to the fine coal aqueous slurry in an undiluted or a diluted form such as an aqueous solution or aqueous emulsion. Because of the limited amount of polyorganosiloxane used in the practice of this invention, it is preferred to add the polyorganosiloxane in a solution or emulsion form so as to insure a more uniform distribution of the polyorganosiloxane collector throughout the aqueous fine coal slurry. The viscosity of the polyorganosiloxane or polyorganosiloxane emulsion should not be so high so as to prevent a rapid and uniform distribution of the polyorganosiloxane throughout the fine coal slurry. Generally, a viscosity of about 3 to 1000 cst at 25° C. for the polyorganosiloxane or polyorganosiloxane emulsion is preferred, with a viscosity of about 3 to 150 cst at 25° C. being most preferred.

The polyorganosiloxane collectors of this invention may be combined with other collectors for the beneficiation of fine coal. A collector which consists of a polyorganosiloxane and mineral oil is one such blend.

The use of the polyorganosiloxane as collectors in the process of this invention results in an improved process for the froth flotation of fine coal. Improvement can be obtained in ash reduction and/or in total yield of beneficiated coal. The collectors of this invention are especially useful in the froth flotation of difficult to float coals such as highly oxidized coals or coals with slime problems where conventional collectors have only limited usefulness.

The following examples are meant to further teach how best to practice this invention and not to limit the invention.

All percentages are by weight unless otherwise noted. It will be realized by one skilled in the art that not all collectors will be satisfactory for all coals. Routine experimentation may be necessary to determine the optimum collector and process parameters for a given coal.

The polyorganosiloxanes that were used in these examples are denoted by letter codes which have the following meanings:

A. A 60 percent emulsion of a polydimethylsiloxane (viscosity about 350 cst) in water with about 3.8 percent trimethylnonylpolyethylene glycol ether (tradename Tergitol TMN-6 from Union Carbide) and about 0.85 percent of the sodium salt of an alkylarylpolyether sulfate (tradename Triton W-30 from Rohm & Haas Co.). This polydimethylsiloxane is included for comparative purposes only.

B. A polyorganosiloxane having the average formula $(CH_3)_3SiO[(CH_3)_2SiO]_7[CH_3QSiO]_3Si(CH_3)_3$ where Q is $-(CH_2)_3(OCH_2CH_2)_{11-12}OH$.

C. A polyorganosiloxane having the average formula $(CH_3)_3SiO[CH_3(CH_3CH_2)SiO]_6[CH_3QSiO]_2Si(CH_3)_3$ where Q is $-CH_2CH(CH_3)C_6H_5$.

D. A polyorganosiloxane having the average formula $HO[CH_3QSiO]_xH$ where Q is $-C_6H_5$ and where x has an average value of about six.

E. A polyorganosiloxane of general formula $$(CH_3)_3SiO[(CH_3)_3SiO]_{15}[CH_3R'SiO]_{2.38}[CH_3Q'SiO]_{0.52}-CH_3Q''SiO]_{0.2}Si(CH_3)_3$$

where R' is a normal alkyl radical (about half the R' radicals contain 12 carbon atoms and half contain 14 carbon atoms), Q' is $-CH_2CH(CH_3)C_6H_5$ and Q'' is $-(CH_2)_3(OCH_2CH_2)_{12}OOCCH_3$.

F. A mixture of polyorganosiloxanes which contains one part of polyorganosiloxane B and one part of polyorganosiloxane D.

G. A mixture of one part of polyorganosiloxane E and one part of mineral oil. The mineral oil used was a petroleum derived hydrocarbon liquid (density 0.82) available under the tradename Shellsol 2046 from Shell Chemical (Australia) Pty. Ltd., Sydney, Australia.

Flotation Tests

Most froth flotation tests were carried out in a Reay/-Ratcliff flotation cell which is more fully described in Reay and Ratcliff, *Can. J. Chem. Engng.*, 53, 481 (1975). The Reay/Ratcliff cell uses a standard Buchner funnel with a fused-in-place sintered disc of porosity 3. Four vertical baffles were added to the funnel to minimize vortex formation during stirring. Agitation was by mechanical stirrer using a pitched four-blade impeller. A small diaphragm pump was used to pressurize the air for bubble formation. For each series of tests about 8 l of an aqueous coal slurry (about 10–12% solids) was prepared. The slurry was continuously stirred. For each test, a 100 ml sample of the aqueous slurry was removed and treated with a predetermined amount of the test collector. The treated aqueous slurry was conditioned by stirring at about 800 rpm for one minute. The treated, conditioned sample was then transferred to the flotation cell where the frothing agent was added. The resulting slurry was further conditioned for 10 seconds with stirring. Flotation was then carried out for three minutes at an aeration rate of 2 liters per minute. Frother and distilled water were added, when needed, to maintain a suitable froth and water level in the cell. The floated coal sample was collected, dried to a constant weight at 105° C., and then analyzed for ash content according to Australian Standards 1038 Part 3-1979. The recovery or percentage yield was determined by Australian Standard 2579.1-1983 by the equation $$\text{Recovery (\%)} = (Mc/Mr) \times 100$$

where Mc equals the weight of the concentrate and Mr equals the weight of the reconstituted feed.

A few flotation experiments were carried out in a larger scale Denver laboratory Model D-12 flotation machine available from Joy Process Equipment Ltd., Surrey, England. A glass 2.5 liter flotation cell was used. Approximately 2 liters of the aqueous slurry was employed in each test. The collector and frothing agent were added to the aqueous coal slurry (10–12% solids) and conditioned for one minute. The froth product was collected over a three-minute period. Impeller speed was about 1500 rpm with the lower face of the impeller not more than 5 mm from the base of the cell. The air flow rate was approximately 4 liters per minute. Ash analysis was carried out as before.

All flotation experiments were carried out at room temperature, approximately 21° C.

EXAMPLES 1–8

The fine coal used was from the Upper Permian German Creek Formation from the German Creek Coal Preparation Plant located about 208 km west of Rockhampton, Queensland, Australia, and owned by German Creek Coal Pty, Ltd. This German Creek coal is classified as a medium volatile bituminous coal in the ASTM classification system. An aqueous slurry of the German Creek coal was subjected to a froth flotation manipulation using different collectors in the Reay/-Ratcliff cell. The frother employed was methylisobutylcarbinol which was present at a level of 0.1 kg per ton of coal. The original German Creek coal had an ash content of 27.9 weight percent. The results are presented in Table I. Examples 1–3 are for comparative purposes. Collector F is a 1:1 by weight mixture of polyorganosiloxane B and polyorganosiloxane D. Collector G is a 1:1 by weight mixture of polyorganosiloxane E and a mineral oil.

TABLE I

| | Collector | | Beneficiated Coal Product | | |
|---|---|---|---|---|---|
| Example | Identity | Level (kg/ton) | Product Ash, % | Ash Reduction, % | Yield % |
| 1 | Diesel Fuel | 0.6 | 19.4 | 30.5 | 62.6 |
| 2 | A | 0.1 | 20.5 | 26.5 | 36.8 |
| 3 | B | 0.1 | 21.4 | 23.3 | 43.3 |
| 4 | C | 0.1 | 19.0 | 31.9 | 59.1 |
| 5 | D | 0.1 | 16.5 | 40.9 | 57.1 |
| 6 | E | 0.1 | 15.9 | 43.0 | 74.4 |
| 7 | F | 0.1 | 16.5 | 40.9 | 74.4 |
| 8 | G | 0.1 | 15.9 | 43.0 | 75.2 |

Clearly the polyorganosiloxanes or mixtures of polyorganosiloxanes having an aryl radical as well as a polyethylene oxide radical (Examples 6–8) performed significantly better than either the standard diesel fuel collector or the polyorganosiloxanes which contain only one of these radicals. Polyorganosiloxanes, which contain aryl radicals without polyethylene oxide radicals or polypropylene oxide radicals, gave a significantly improved yield and ash reduction as compared to the prior art siloxane collector as shown in Example 2.

EXAMPLES 9–15

The fine coal employed in these Examples was from the Upper Permian Wittingham coal seam from the Liddell State Coal Preparation Plant near Ravensworth, New South Wales, Australia, which is owned by Elcom Collieries Pty. Ltd. This Wittingham coal is a high volatile A bituminous coal in the ASTM classification system. An aqueous slurry of this coal was subjected to a froth flotation manipulation using various collectors in the Reay/Ratcliff cell. The frothing agent was methylisobutylcarbinol at a level of 0.1 kg per ton of coal. The Wittingham coal has an ash content of 22.2 percent before beneficiation. The results are presented in Table II. Examples 9–10 are for comparative purposes. Collector F is a 1:1 by weight mixture of polyorganosiloxane B and polyorganosiloxane D.

TABLE II

| | Collector | | Beneficiated Coal Product | | |
|---|---|---|---|---|---|
| Example | Identity | Level (kg/ton) | Product Ash, % | Ash Reduction, % | Yield % |
| 9 | Diesel Fuel | 0.6 | 15.3 | 31.1 | 80.2 |
| 10 | A | 0.1 | 14.5 | 34.7 | 52.1 |
| 11 | B | 0.1 | 18.9 | 14.9 | 80.0 |
| 12 | C | 0.1 | 17.2 | 22.5 | 63.4 |
| 13 | D | 0.1 | 15.6 | 29.7 | 77.0 |
| 14 | E | 0.1 | 15.0 | 32.4 | 89.2 |
| 15 | F | 0.1 | 12.6 | 43.2 | 81.9 |

The polyorganosiloxanes or mixtures of polyorganosiloxanes which contain both aryl and polyethylene oxide radicals (Examples 14 and 15) performed better than the standard diesel fuel. The polyorganosiloxanes which contained aryl radicals (Examples 12 and 13) did have a significantly improved yield as compared to the prior art siloxane collector as shown in Example 10.

EXAMPLES 16–19

The fine coal used in Examples 16–19 was from the Mount Arthur seam from the Liddell Coal Preparation Plant owned by Coal and Allied Industries Ltd. located near Ravensworth, New South Wales, Australia. The Mount Arthur coal is a high volatile A bituminous coal. This particular coal sample was considered a "difficult to float" coal. An aqueous slurry of the Mount Arthur coal was subjected to a froth flotation process using different collectors in the Reay/Ratcliff cell. The frother used was methylisobutylcarbinol at a level of 0.1 kg per ton coal. The Mount Arthur coal had an ash content of 21.9 weight percent. The results are presented in Table III. Examples 16 and 17 are for comparison. Using diesel fuel as a collector (Example 16) resulted in no recovered coal from this difficult-to-float coal sample.

TABLE III

| | Collector | | Beneficiated Coal Product | | |
|---|---|---|---|---|---|
| Example | Identity | Level (kg/ton) | Product Ash, % | Ash Reduction, % | Yield % |
| 16 | Diesel | 0.6 | — | — | 0 |
| 17 | A | 0.5 | 19.5 | 11.0 | 12 |
| 18 | E | 0.5 | 11.8 | 46.1 | 70 |

TABLE III-continued

| | Collector | | Beneficiated Coal Product | | |
|---|---|---|---|---|---|
| Example | Identity | Level (kg/ton) | Product Ash, % | Ash Reduction, % | Yield % |
| 19 | F | 0.5 | 11.6 | 47.0 | 56 |

The use of the polyorganosiloxanes of this invention as collectors resulted in significantly improved results for the froth flotation of the Mount Arthur coal as compared to either a diesel fuel collector or to the prior art siloxane collector. These examples show that the polyorganosiloxane collector of this invention are especially suited for the beneficiation of difficult-to-float coal using a froth flotation process.

EXAMPLES 20–25

The coal used in these examples is from the Goonyella Upper Seam which is located about 100 km southwest of Mackay, Queensland, Australia, and owned by Thiess Dampier Mitsui Coal Pty. Ltd. The Goonyella coal is a medium volatile bituminous coal. An aqueous slurry of the Goonyella coal was subjected to a froth flotation process using various collectors in the Reay/Ratcliff cell and a methylisobutylcarbinol frothing agent at a level of 0.1 kg per ton of coal. The Goonyella coal had an ash content of 19.1 percent. The results are presented in Table IV. Examples 20–22 are for comparative purposes. Collector F is a 1:1 by weight mixture of polyorganosiloxane B and polyorganosiloxane D. Collector G is a 1:1 mixture of polyorganosiloxane E and a mineral oil.

TABLE IV

| | Collector | | Beneficiated Coal Product | | |
|---|---|---|---|---|---|
| Example | Identity | Level (kg/ton) | Product Ash, % | Ash Reduction, % | Yield % |
| 20 | Diesel Fuel | 0.6 | 12.2 | 36.1 | 73.7 |
| 21 | A | 0.1 | 17.0 | 11.0 | 40.2 |
| 22 | B | 0.1 | 17.3 | 9.4 | 42.9 |
| 23 | E | 0.1 | 11.5 | 39.8 | 87.8 |
| 24 | F | 0.1 | 12.8 | 33.0 | 61.0 |
| 25 | G | 0.1 | 11.9 | 37.7 | 90.1 |

The best polyorganosiloxane collector for the beneficiation of Goonyella coal was collector E (in Examples 23 and 25) which contains both aryl radicals and polyethylene oxide radicals.

EXAMPLES 26–27

Coal from the Liddell seam from the Liddell State Coal Preparation Plant near Ravensworth, New South Wales, Australia, was employed for Examples 26–27. The ASTM classification is high volatile A bituminous. An aqueous slurry of the Liddell coal was subjected to a series of froth flotation manipulations using various collectors in the Reay/Ratcliff cell. The frothing agent was methylisobutylcarbinol (MIBC). The results are presented in Table V. Example 26 is for comparison purposes. The aryl containing polyorganosiloxane collector allowed for a greater ash reduction relative to the standard diesel fuel collector.

TABLE V

| Example | Collector Identity | Collector Level (kg/ton) | MIBC (kg/ton) | Feed Ash, % | Beneficiated Coal Product Product Ash, % | Beneficiated Coal Product Ash Reduction, % | Beneficiated Coal Product Yield % |
|---|---|---|---|---|---|---|---|
| 26 | Diesel Fuel | 0.51 | 0.09 | 19.5 | 15.7 | 19.5 | 76.4 |
| 27 | D | 0.12 | 0.10 | 19.4 | 14.1 | 27.3 | 61.2 |

EXAMPLES 28–30

Two different Hunter Valley coals were evaluated using polyorganosiloxane E as the collector. The coals were from Coal and Allied Industries' Liddell Coal Preparation Plant near Ravensworth, New South Wales, Australia. One coal is a medium volatile bituminous coking coal and the other is a high grade thermal coal. Both coals are difficult-to-float. In fact, using the standard diesel fuel collector with both the coking coal and the thermal coal resulted in zero recovery. Flotation was carried out in the Denver D-12 cell. The frothing agent used was methylisobutylcarbinol. The results are given in Table VI. As can be seen from Table VI, the use of polyorganosiloxane E as a collector results in high yield with significantly reduced ash level for two difficult-to-float coals which could not be floated with a standard diesel collector.

TABLE VI

| Example | Coal | Siloxane (kg/ton) | MIBC (kg/ton) | Feed Ash, % | Beneficiated Coal Product Product Ash, % | Beneficiated Coal Product Ash Reduction, % | Beneficiated Coal Product Yield % |
|---|---|---|---|---|---|---|---|
| 28 | Coking | 0.20 | 0.18 | 21.2 | 10.0 | 52.8 | 62.8 |
| 29 | Thermal | 0.24 | 0.20 | 24.0 | 12.0 | 50.0 | 77.7 |
| 30 | Thermal | 0.48 | 0.36 | 21.5 | 11.2 | 47.9 | 81.9 |

EXAMPLES 31–41

Both polyorganosiloxanes E and F have been evaluated as collectors at various addition levels. The coal employed was from the German Creek seam as described in Examples 1–8. Example 31 is included for comparison. The frothing agent was methylisobutylcarbinol. The results, obtained in the Denver D-12 flotation cell, are presented in Table VII. For this particular coal, the polyorganosiloxane E is very effective at very low concentrations and again at higher concentrations; whereas polyorganosiloxane F becomes more effective as concentration increases. Both E and F are more effective than diesel fuel at lower concentrations.

TABLE VII

| Example | Collector Identity | Collector Level (kg/ton) | MIBC (kg/ton) | Feed Ash, % | Beneficiated Coal Product Product Ash, % | Beneficiated Coal Product Ash Reduction, % | Beneficiated Coal Product Yield % |
|---|---|---|---|---|---|---|---|
| 31 | Diesel Fuel | 1.5 | 0.11 | 30.5 | 10.8 | 64.5 | 40.8 |
| 32 | E | 0.035 | 0.05 | 28.5 | 9.1 | 68.1 | 50.0 |
| 33 | E | 0.069 | 0.09 | 28.5 | 9.4 | 67.0 | 46.9 |
| 34 | E | 0.093 | 0.10 | 29.7 | 16.4 | 44.8 | 37.3 |
| 35 | E | 0.16 | 0.09 | 32.3 | 15.6 | 51.7 | 41.2 |
| 36 | E | 0.19 | 0.11 | 31.4 | 11.0 | 65.0 | 56.8 |
| 37 | F | 0.024 | 0.05 | 28.6 | 30.4 | −6.3 | 17.0 |
| 38 | F | 0.039 | 0.06 | 29.1 | 23.6 | 18.9 | 19.4 |
| 39 | F | 0.13 | 0.05 | 30.9 | 17.4 | 43.7 | 41.0 |
| 40 | F | 0.53 | 0.10 | 30.8 | 9.8 | 68.2 | 59.5 |
| 41 | F | 0.70 | 0.11 | 31.1 | 9.7 | 68.8 | 64.7 |

That which is claimed is:

1. A froth flotation process for the beneficiation of fine coal, which process comprises the steps of forming an aqueous slurry of the fine coal, adding a collector and a frothing agent to the aqueous slurry of fine coal, subjecting the aqueous slurry of fine coal containing the collector and frothing agent to froth flotation and separating the floated material which consists essentially of the beneficiated fine coal, wherein the collector is a water-dispersible polyorganosiloxane, or a mixture of water-dispersible polyorganosiloxanes, of the general formula $$R_aQ_bSiO_{(4-a-b)/2}$$

where a has an average value of 0 to less than four, b has an average value of greater than zero to less than four, the sum (a+b) has an average value of 0.9 to 2.7, R is a monovalent alkyl radical containing 1 to 20, inclusive, carbon atoms or a —OH radical, and Q is an aryl radical, attached to silicon through a Si—C bond, which is selected from the group consisting of phenyl, benzhydryl, benzyl, alpha-methylbenzyl, methylbenzyl, tolyl, phenethyl, alpha-methylphenethyl, and beta-methylphenethyl radicals.

2. A froth flotation process as defined in claim 1 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

3. A froth flotation process as defined in claim 2 wherein said frother is methylisobutylcarbinol.

4. A froth flotation process for the beneficiation of fine coal, which process comprises the steps of forming an aqueous slurry of the fine coal, adding a collector and a frothing agent to the aqueous slurry of fine coal, subjecting the aqueous slurry of fine coal containing the collector and frothing agent to froth flotation, and separating the floated material which consists essentially of the beneficiated fine coal, wherein the collector is a water-dispersible polyorganosiloxane, or a mixture of water-dispersible polyorganosiloxanes, of general formula $$Q_cR_{(3-c)}SiO[R_2'SiO]_n[R'QSiO]_mSiR_{(3-d)}Q_d$$

where n has a value of 0 to 100, inclusive; m has a value of 0 to 70, inclusive; c and d are both independently equal to 0 or 1; the sum (m+c+d) is equal to or greater than 1; R is a monovalent alkyl radical containing from 1 to 20, inclusive, carbon atoms or a —OH radical; R' is a monovalent alkyl radical containing from 1 to 20, inclusive, carbon atoms; and Q is an aryl radical attached to silicon through a Si—C bond.

5. A froth flotation process as defined in claim 4 wherein both c and d are zero and m has a value of 1 to 12, inclusive.

6. A froth flotation process as defined in claim 5 wherein said frother is methylisobutylcarbinol.

7. A froth flotation process as defined in claim 5 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

8. A froth flotation process as defined in claim 7 wherein said frother is methylisobutylcarbinol.

9. A froth flotation process as defined in claim 4 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

10. A froth flotation process as defined in claim 9 wherein said frother is methylisobutylcarbinol.

11. A froth flotation process for the beneficiation of fine coal, which process comprises forming an aqueous slurry of the fine coal containing a collector and a frothing agent, subjecting the aqueous slurry of the fine coal containing the collector and frothing agent to a froth flotation manipulation, and separating the tailing of the froth flotation manipulation from the floated material which consists essentially of the beneficiated fine coal wherein the collector is a water-dispersible polyorganosiloxane or a mixture of water-dispersible polyorganosiloxanes of general formula $$Q_cR_{(3-c)}SiO[R_2'SiO]_n[R'QSiO]_mSiR_{(3-d)}Q_d$$

where n has a value of 0 to 100, inclusive; m has a value of 0 to 70, inclusive: c and d are both independently equal to 0 or 1; the sum (m+c+d) is equal to or greater than 1; R is a monovalent alkyl radical containing from 1 to 20, inclusive, carbon atoms or a —OH radical; R' is a monovalent alkyl radical containing from 1 to 20, inclusive, carbon atoms; and at least two different Q radicals are present where the first Q radical is an aryl radical and the second Q radical is selected from the group consisting of polyethylene oxide radicals and polypropylene oxide radicals where said Q radicals are attached to silicon through a Si—C bond.

12. A froth flotation process as defined in claim 11 wherein both c and d are zero and m has a value of 1 to 12, inclusive.

13. A froth flotation process as defined in claim 12 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

14. A froth flotation process as defined in claim 11 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

15. A froth flotation process as defined in claim 14 wherein the frother is methylisobutylcarbinol.

16. A froth flotation process as defined in claim 11 wherein said first Q radical is selected from the group consisting of phenyl and beta-methylphenethyl radicals.

17. A froth flotation process as defined in claim 16 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

18. A froth flotation process as defined in claim 11 wherein said second Q radical is described by the general formula $$—D(OC_2H_4)_x(OC_3H_6)_yB$$

where D is an alkylene radical containing from 2 to 18 carbon atoms; x has a value of 0 to 20, inclusive; y has a value of 0 to 5, inclusive; the sum (x+y) is equal to or greater than 1; and B is selected from the group consisting of $$—OR'', —O\overset{O}{\overset{\|}{C}}R'', —O\overset{O}{\overset{\|}{C}}OR'', \text{ and } —O\overset{O}{\overset{\|}{C}}D'COOH$$

where R'' is a hydrogen atom or a hydrocarbon radical free of aliphatic unsaturation which contains from 1 to 10 carbon atoms and where D' is an alkylene radical containing from 1 to 18 carbon atoms.

19. A froth flotation process as defined in claim 18 wherein said first Q radical and said second Q radical are present on the same polyorganosiloxane.

20. A froth flotation process as defined in claim 19 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

21. A froth flotation process as defined in claim 20 wherein the frother is methylisobutylcarbinol.

22. A froth flotation process as defined in claim 18 wherein said collector is a mixture of water-dispersible polyorganosiloxanes and said first Q radical and said second Q radical are present on different polyorganosiloxanes.

23. A froth flotation process as defined in claim 22 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

24. A froth flotation process as defined in claim 23 wherein the frother is methylisobutylcarbinol.

25. A froth flotation process as defined in claim 18 wherein both c and d are zero and m has a value of 1 to 12, inclusive.

26. A froth flotation process as defined in claim 25 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

27. A froth flotation process as defined in claim 18 wherein said first Q radical is selected from the group consisting of phenyl and beta-methylphenethyl radicals.

28. A froth flotation process as defined in claim 27 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

29. A froth flotation process as defined in claim 18 wherein D is an alkylene radical containing 2 to 6 carbon atoms; wherein x has a value of 5 to 15, inclusive; and wherein y is greater than zero, the ratio of x to y is at least 2 to 1.

30. A froth flotation process as defined in claim 29 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

31. A froth flotation process as defined in claim 29 wherein y is zero and B is —OH.

32. A froth flotation process as defined in claim 31 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

33. A froth flotation process as defined in claim 18 wherein said aqueous slurry of fine coal contains 2 to 25 weight percent solids; wherein the particle size of said fine coal is less than 50 mesh; wherein said frother is added at a level of about 0.05 to 2.0 kg per ton of fine coal; and wherein said collector is added at a level of about 0.05 to 1.0 kg per ton of fine coal.

34. A froth flotation process as defined in claim 33 wherein the frother is methylisobutylcarbinol.

* * * * *